US009390896B2

(12) United States Patent
Brown et al.

(10) Patent No.: US 9,390,896 B2
(45) Date of Patent: Jul. 12, 2016

(54) DATA DIRECTED ACQUISITION OF IMAGING MASS

(71) Applicant: Micromass UK Limited, Wilmslow (GB)

(72) Inventors: Jeffery Mark Brown, Hyde (GB); Richard Chapman, Runcorn (GB); Paul Murray, Manchester (GB); Keith Richardson, Derbyshire (GB); Emmy Maria Hoyes, Mellor (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 14/776,175

(22) PCT Filed: Mar. 14, 2014

(86) PCT No.: PCT/GB2014/050808

§ 371 (c)(1),
(2) Date: Sep. 14, 2015

(87) PCT Pub. No.: WO2014/140628

PCT Pub. Date: Sep. 18, 2014

(65) Prior Publication Data

US 2016/0049282 A1 Feb. 18, 2016

(30) Foreign Application Priority Data

Mar. 15, 2013 (EP) ..... 13159575
Mar. 15, 2013 (GB) ..... 1304757.6

(51) Int. Cl.
*H01J 49/00* (2006.01)
*H01J 49/16* (2006.01)

(52) U.S. Cl.
CPC ..... *H01J 49/0004* (2013.01); *H01J 49/164* (2013.01)

(58) Field of Classification Search
USPC ..... 250/281, 282
See application file for complete search history.

(56) References Cited

U.S. PATENT DOCUMENTS 7,655,476 B2 2/2010 Bui
2004/0183006 A1 9/2004 Reilly et al.

(Continued)

FOREIGN PATENT DOCUMENTS

JP 2007/225285 9/2007
JP 2007/257851 10/2007

*Primary Examiner* — Nicole Ippolito
(74) *Attorney, Agent, or Firm* — Diederiks & Whitelaw, PLC

(57) ABSTRACT

A method of ion imaging is disclosed comprising scanning a sample at a first resolution and acquiring first mass spectral data related to a first pixel location. A determination is then made as to whether or not the first mass spectral data satisfies a condition, wherein if it is determined that the first mass spectral data does satisfy the condition then the method further comprises: (i) switching to acquire second mass spectral data related to a second pixel location which is substantially adjacent to the first pixel location so that the second mass spectral data is acquired at a second resolution which is higher than the first resolution; and (ii) determining whether or not the second mass spectral data satisfies the condition, wherein if it is determined that the second mass spectral data does satisfy the condition then the method further comprises acquiring third mass spectral data related to a third pixel location which is substantially adjacent to the first or second pixel locations so that the third mass spectral is acquired at the second resolution and wherein if it is determined that the second or third mass spectral data does not satisfy the condition then the method further comprises switching back to scanning the sample at the first resolution.

10 Claims, 8 Drawing Sheets

(56) References Cited

U.S. PATENT DOCUMENTS

2004/0183009 A1 9/2004 Reilly et al.
2007/0141718 A1 6/2007 Bui
2011/0280455 A1* 11/2011 Alexandrov ..... H01J 49/0036 382/128
2012/0085903 A1* 4/2012 Trimpin ..... H01J 49/044 250/282
2013/0056628 A1* 3/2013 Holle ..... H01J 49/0004 250/282
2015/0348767 A1* 12/2015 Makarov ..... H01J 49/0031 250/282

* cited by examiner

DATA DIRECTED ACQUISITION OF IMAGING MASS

CROSS-REFERENCE TO RELATED APPLICATION

This application is the National Stage of International Application No. PCT/GB2014/050808, filed 14 Mar. 2014 which claims priority from and the benefit of United Kingdom patent application No. 1304757.6 filed on 15 Mar. 2013 and European patent application No. 13159575.3 filed 15 Mar. 2013. The entire contents of these applications are incorporated herein by reference.

BACKGROUND TO OF THE PRESENT INVENTION

The present invention relates to a method of ion imaging, a method of mass spectrometry and a mass spectrometer.

It is known to perform a method of ion imaging wherein an array of mass spectral data is obtained across a sample.

U.S. Pat. No. 7,655,476 (Bui) discloses an arrangement wherein a first coarse full area scan is obtained to allow areas of interest to be determined and a post first scan acquisition is performed by defining a gradient search to find boundaries followed by a subsequent acquisition of these areas at high resolution.

US 2004/0183009 (Reilly) discloses a MALDI mass spectrometer having a laser steering assembly.

JP 2007-225285 (Shuichi) discloses a method of generating a two-dimensional mass distribution image using a MALDI ion source.

JP 2007-257851 (Shuichi) discloses using a MALDI ion source to measure a detailed two-dimensional substance distribution with a high spatial resolution.

It is desired to provide an improved method of ion imaging.

SUMMARY OF THE PRESENT INVENTION

According to an aspect of the present invention there is provided a method of ion imaging comprising:

scanning a sample at a first resolution and acquiring first mass spectral data related to a first pixel location;

determining whether or not the first mass spectral data satisfies a condition, wherein if it is determined that the first mass spectral data does satisfy the condition then the method further comprises:

(i) switching to acquire second mass spectral data related to a second pixel location which is substantially adjacent to the first pixel location so that the second mass spectral data is acquired at a second resolution which is higher than the first resolution; and (ii) determining whether or not the second mass spectral data satisfies the condition, wherein if it is determined that the second mass spectral data does satisfy the condition then the method further comprises acquiring third mass spectral data related to a third pixel location which is substantially adjacent to the first or second pixel locations so that the third mass spectral is acquired at the second resolution and wherein if it is determined that the second or third mass spectral data does not satisfy the condition and preferably a sample region has been surveyed then the method preferably further comprises switching back to scanning the sample at the first resolution.

FIGS. 9-11 of U.S. Pat. No. 7,655,476 (Bui) disclose an arrangement wherein target areas are randomly distributed across an area to be imaged. A first imaging scan is then performed at low resolution by sequentially irradiating each of the target areas.

All the low resolution data once acquired is then analysed to identify one or more areas of interest. High resolution target regions are then disposed within the areas of interest and are arranged to fill in areas of interest as shown in FIG. 11 of U.S. Pat. No. 7,655,476 (Bui).

It should be noted that the present invention initially starts scanning a sample at a first (low) spatial resolution. If ions of interest are determined to be present then the present invention switches to acquiring mass spectral data at an adjacent pixel location and hence at a second higher spatial resolution. This process continues until it is determined that mass spectral data acquired at the higher spatial resolution no longer includes ions of interest. At this point the ion imaging method switches back to continuing to acquire mass spectral data at the first low spatial resolution.

It should be apparent that the approach disclosed in U.S. Pat. No. 7,655,476 (Bui) does not interrupt the process of acquiring low resolution mass spectral data by switching to acquire high resolution data at adjacent pixel locations nor does it disclose switching back to acquire low resolution data if the mass spectral data no longer includes ions of interest. In contrast, the approach disclosed in U.S. Pat. No. 7,655,476 (Bui) is to obtain low resolution data across the whole of a sample and only then to post-process the data to identify regions of interest at which point second higher resolution data is obtained for the identified regions of interest.

An advantage of the present invention is that mass spectral data which is obtained at low resolution can immediately be discarded if it is determined that the mass spectral data at a particular pixel location is not of interest. In contrast, the approach disclosed in U.S. Pat. No. 7,655,476 (Bui) requires all the mass spectral data which is obtained during a low resolution scan to be retained so that it can be post-processed to determine regions of interest. It is apparent, therefore, that the conventional approach requires the retention and post-processing of potentially an enormous amount of mass spectral data.

In contrast, the present invention is able to significantly reduce the amount of mass spectral data which is retained and processed.

The approach according to the present invention is therefore particularly advantageous compared to the approach disclosed in U.S. Pat. No. 7,655,476 (Bui).

A new method is disclosed that determines whether a mass spectrum acquired at a particular pixel location contains information of interest during an acquisition in order to reduce data sets to comprise only relevant information thereby reducing acquisition time.

When screening a tissue section for ions having a known mass to charge ratio and/or ion mobility the aim is to identify the locality of the ion(s) of interest.

According to the preferred embodiment only mass spectra with ions of interest present are of any relevance. The instrument is preferably configured to perform a low resolution raster scan over a tissue sample until it locates a pixel location where the intensity of an ion of interest exceeds a defined threshold level or other predefined condition. At this point the instrument then preferably reverts to a high resolution acquisition acquiring spectra from adjacent pixels up to the point where the intensity of the ion of interest falls in intensity to a level below the threshold. The process of determining the acquisition pattern may comprise a flood fill method or local search method.

Once all adjacent pixels are determined to have ion intensities below a threshold then the instrument preferably returns to a coarse, low resolution raster scan until the next location where the ion of interest has an intensity above the threshold, at which point the process is then preferably repeated.

Other methods to increase acquisition rates for targeted analysis rely on using a low resolution imaging pattern to determine the contours of an area to be analysed at higher resolution before switching to a high resolution imaging mode to investigate the identified regions of interest.

The size of ion imaging data sets can result in long processing times and long times for transferring data for further processing. Reduction in the data sizes to only spectra that actually contain relevant information in a manner according to the present invention can significantly reduce the time to handle the data sets and generate ion images that can be interrogated for specific ions.

The conditional determination of what are considered relevant spectra may be used to determine regions of interest rather than the localities of specific ions of interest. This can allow the instrument rather than the user to define the extent of an experiment.

Accuracies of co-registration between the tissue image, the regions of interest defined by the user prior to acquisition and the instrument stage position become less critical as the preferred method determines the regions of interest in a data directed manner.

The step of determining whether or not the mass spectral data satisfies the condition preferably comprises determining whether or not the mass spectral data includes: (i) ions having an intensity above a threshold; (ii) ions having one or more mass to charge ratios of interest; (iii) ions having one or more mass to charge ratios of interest and an intensity above a threshold; (iv) ions having one or more ion mobilities of interest; or (v) ions having one or more ion mobilities of interest and an intensity above a threshold.

The step of acquiring mass spectral data at the first resolution preferably comprises performing a raster scan of the sample.

The step of acquiring mass spectral data at the first resolution may comprise performing a random scan, a flood fill, a local search, a scanline or a tree search of the sample.

The step of acquiring mass spectral data at the second resolution preferably comprises performing an acquisition pattern.

The step of performing the acquisition pattern preferably comprises performing a random scan, a flood fill, a local search, a scanline or a tree search of the sample.

The step of performing the acquisition pattern preferably comprises mapping out and acquiring mass spectral data from one or more regions of interest.

The method preferably further comprises determining the location of particular ions of interest within the one or more regions of interest.

The step of determining the location of particular ions of interest preferably comprises determining the location of a drug, metabolite, chemical substance or biological substance within the sample.

According to another aspect of the present invention there is provided a method of mass spectrometry comprising a method of ion imaging as described above.

According to another aspect of the present invention there is provided a mass spectrometer comprising:

a control system arranged and adapted:

(i) to scan a sample at a first resolution and to acquire first mass spectral data related to a first pixel location;

(ii) to determine whether or not the first mass spectral data satisfies a condition, wherein if it is determined that the first mass spectral data does satisfy the condition then the control system is further arranged and adapted:

(iii) to switch to acquire second mass spectral data related to a second pixel location which is substantially adjacent to the first pixel location so that the second mass spectral data is acquired at a second resolution which is higher than the first resolution; and (iv) to determine whether or not the second mass spectral data satisfies the condition, wherein if it is determined that the second mass spectral data does satisfy the condition then the control system is arranged to acquire third mass spectral data related to a third pixel location which is substantially adjacent to the first or second pixel locations so that the third mass spectral is acquired at the second resolution and wherein if it is determined that the second or third mass spectral data does not satisfy the condition and preferably a sample region has been surveyed then the control system is preferably arranged to switch back to scanning the sample at the first resolution.

According to another aspect of the present invention there is provided a method of ion imaging comprising:

acquiring mass spectral data at a first spatial resolution;

switching to acquire mass spectral data at a second higher spatial resolution if one or more ions of interest are determined to be present and then mapping out and acquiring mass spectral data relating to a region of interest at the second spatial resolution; and then switching back to acquiring mass spectral data at the first spatial resolution.

According to another aspect of the present invention there is provided a mass spectrometer comprising:

a control system arranged and adapted:

(i) to acquire mass spectral data at a first spatial resolution;

(ii) to switch to acquire mass spectral data at a second higher spatial resolution if one or more ions of interest are determined to be present and to then map out and acquire mass spectral data relating to a region of interest at the second spatial resolution; and then (iii) to switch back to acquiring mass spectral data at the first spatial resolution.

According to an embodiment negative result spectra or first mass spectral data which does not satisfy the condition may be discarded. Alternatively, negative result spectra or first mass spectral data which does not satisfy the condition may be stored for future post acquisition analysis and/or confirmation.

Embodiments are contemplated wherein a decision may be made whether or not to discard negative result spectra or to store negative result spectra for post-acquisition analysis.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; and (xxviii) a Laser Ablation Electrospray Ionisation ("LAESI") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may further comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer further comprises a device arranged and adapted to supply an AC or RF voltage to the electrodes. The AC or RF voltage preferably has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The AC or RF voltage preferably has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The mass spectrometer may also comprise a chromatography or other separation device upstream of an ion source. According to an embodiment the chromatography separation device comprises a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide is preferably maintained at a pressure selected from the group consisting of: (i) <0.0001 mbar; (ii) 0.0001-0.001 mbar; (iii) 0.001-0.01 mbar; (iv) 0.01-0.1 mbar; (v) 0.1-1 mbar; (vi) 1-10 mbar; (vii) 10-100 mbar; (viii) 100-1000 mbar; and (ix) >1000 mbar.

BRIEF DESCRIPTION OF THE DRAWINGS

Various embodiments of the present invention will now be described, by way of example only, and with reference to the accompanying drawings in which.

DETAILED DESCRIPTION OF PREFERRED EMBODIMENTS

Figure 1:
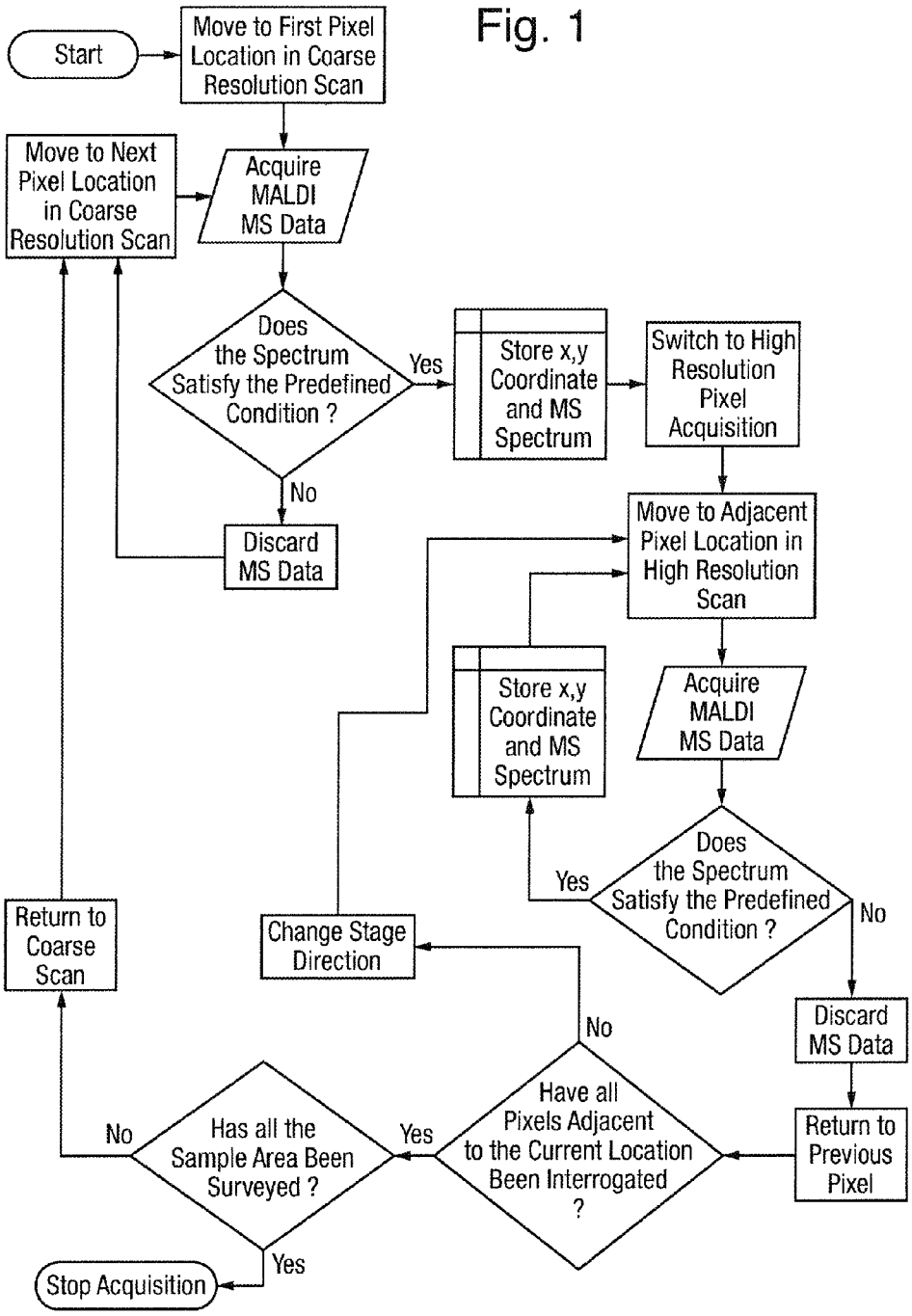
FIG. 1 shows a data directional search approach according to the preferred embodiment.

A preferred embodiment of the present invention will now be described.

When performing an ion imaging experiment the amount of data generated can be excessive making it slow to process. According to a preferred embodiment of the present invention a data directed approach is preferably used to determine whether a pixel under analysis is in a region of interest by deciding whether the acquired spectrum contains relevant spectral content and to direct the operation of the instrument to reduce acquisition time and dataset size significantly.

By limiting the stored data and areas of a sample analyzed at high resolution to regions where the mass spectral data actually contains targeted ions of interest above a given intensity threshold, and surveying the whole of the sample in a low resolution mode, samples can be interrogated and the relevant information obtained within a fraction of the time taken to fully analyze the whole sample. In addition to a simple ion threshold condition being used to determine whether a pixel is of relevance or not other conditions can also be applied.

In the preferred method detailed below, the ion imaging acquisition preferably begins with the instrument in a "search" mode. In its simplest form the instrument acquires data from pixels distributed in a grid pattern with a low resolution i.e. the distance between each pixel is relatively large (user defined). At each pixel a MALDI acquisition is preferably acquired and the resulting data is preferably analysed for the presence of a targeted pre-defined ion mass to charge ratio above a set threshold or other pre-defined criterion. If the criterion is not satisfied, the mass spectral data is preferably discarded and the instrument preferably moves to the next pixel, and so on. Once a pixel where the mass spectral data satisfies the criterion is encountered the instrument preferably switches to a high resolution interrogation of the immediately surrounding pixels with much smaller (user defined) pitch between pixels. After each acquisition the data is preferably examined to determine whether or not the criterion is satisfied. If it is, then the next pixel is analysed, and so on. If not, then the instrument discards the spectrum and returns to the previous pixel before moving to an alternative neighboring location. In this way the extent of the region containing the target ions can be determined.

Once the boundaries of a region of interest have been defined, the internal area of the region can be interrogated in a similar manner and high resolution imaging data within that region is preferably collected.

After the region has been completely analysed the instrument preferably reverts back to the "search" mode until the next pixel satisfying the criterion is located.

The process is preferably repeated until the sample has been fully surveyed.

Other defined criteria can be used to direct the instrument, including peptide mass fingerprinting and MOWSE scores, Principle Component Analysis ("PCA") and the presence of multiple mass to charge ratio ions (as an either/or condition or as a requirement for all ions to be present).

According to an embodiment the pattern traced during the "search" mode need not be a simple raster but may comprise a random walk or other pattern.

The method used for the high resolution acquisition may comprise a local search method to define boundaries within an image.

Using a data directed search approach to direct the movement of the sample stage reduces the acquisition time and the size of the acquired data set.

The experimental workflow after defining an area to be imaged, the pitch of the coarse survey scan and pixel high resolution is outlined as shown in FIG. 1

This approach can be applied to data acquired on MALDI mass spectrometers.

By retaining the full spectral content of pixels identified as being of interest other co-localized species can be analyzed.

Figure 2:
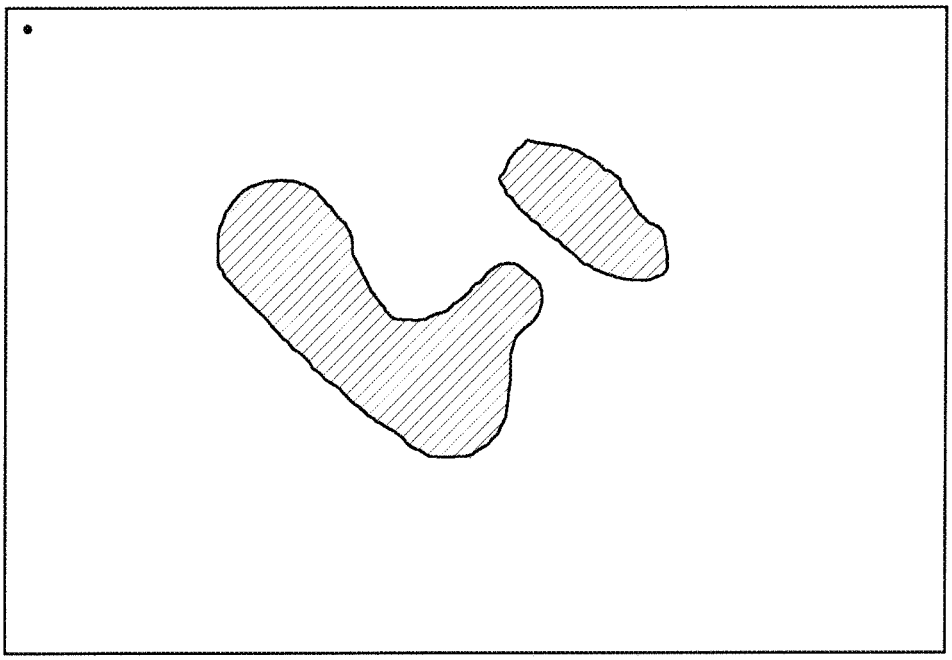
FIG. 2 shows an image of a sample plate with a sample mounted and a first pixel.

FIG. 2 shows an image of a sample plate with a sample mounted. The area to be analysed is the full area of the plate and actual regions of interest are indicated by dark shading. A first initial pixel is shown.

Figure 3:
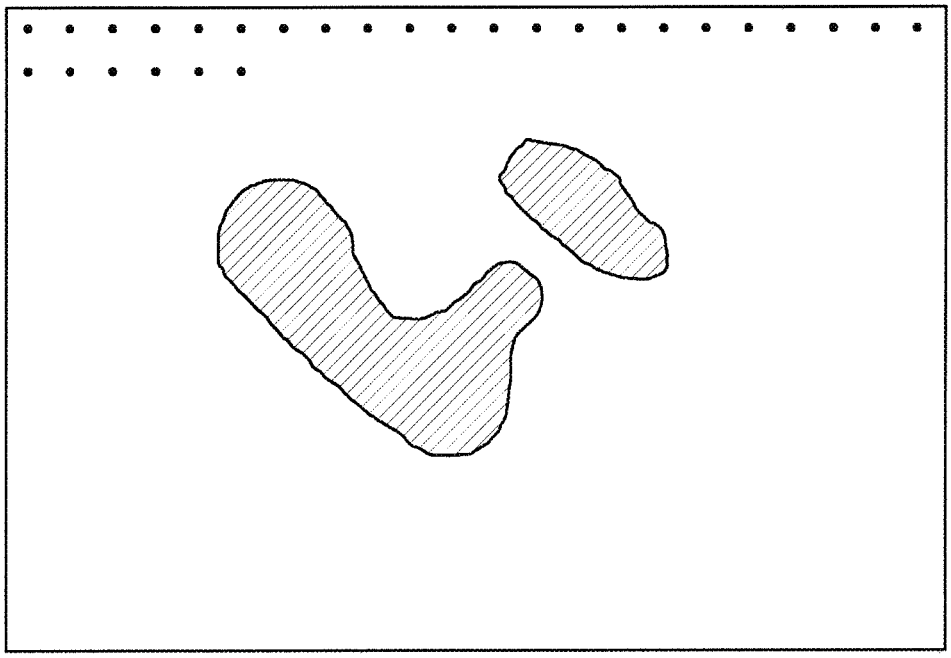
FIG. 3 shows an image of the sample plate with sample mounted showing pixels of a point by point progression of a coarse raster search for a region of interest.

FIG. 3 shows an image of the sample plate and shows the pixels of a point by point progression of a coarse raster search for a region of interest. MS spectra is discarded since it does not satisfy the search criteria.

Figure 4:
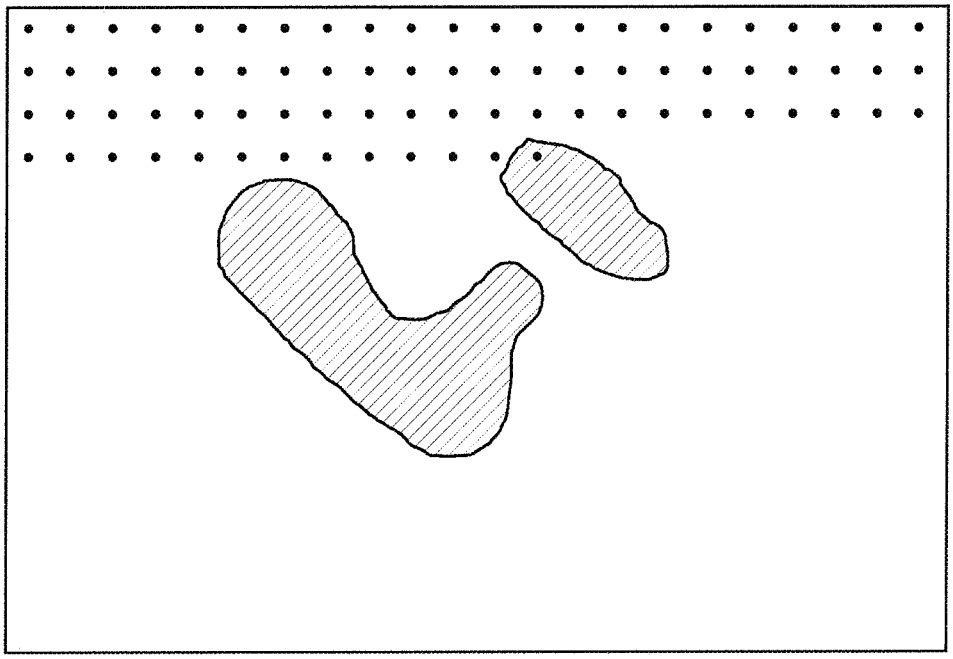
FIG. 4 shows an image of a sample plate at a point when the coarse search has located a point of interest at which point it stores the location and MS data.

FIG. 4 shows an image of the sample plate showing a point at which the coarse search locates a region of interest at which point the instrument stores the location and the MS data.

Figure 5:
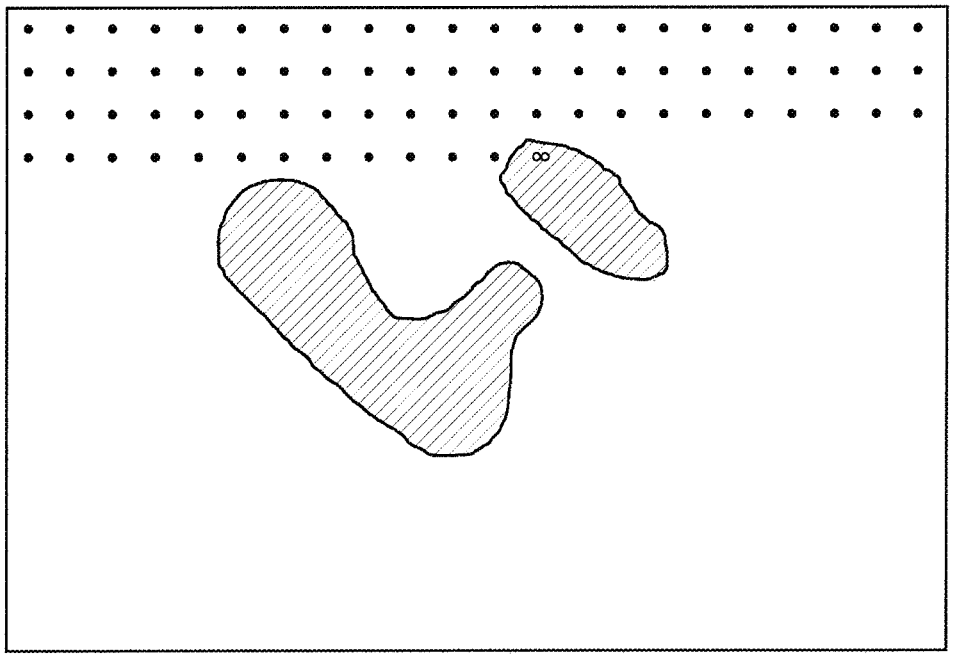
FIG. 5 shows the instrument switching to perform high resolution imaging and starting to interrogate adjacent pixels whilst storing the MS data.

FIG. 5 shows the instrument switching to perform high resolution imaging and starting to interrogate adjacent pixels whilst storing the MS data.

Figure 6:
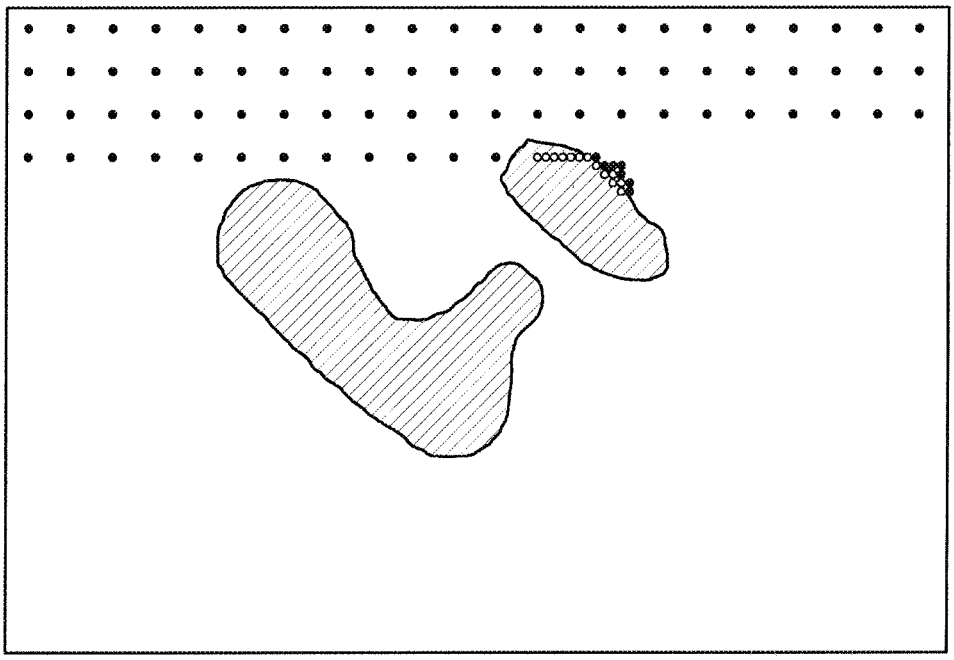
FIG. 6 shows the instrument having determined the location of an edge of a region of interest and progressing around its contours whilst keeping MS data that satisfies the search criteria and discarding data that does not.

FIG. 6 shows the instrument determining the location of an edge of the region of interest and progressing around its contours and at the same time keeping MS data that satisfies the search criteria and discarding MS data that does not.

Figure 7:
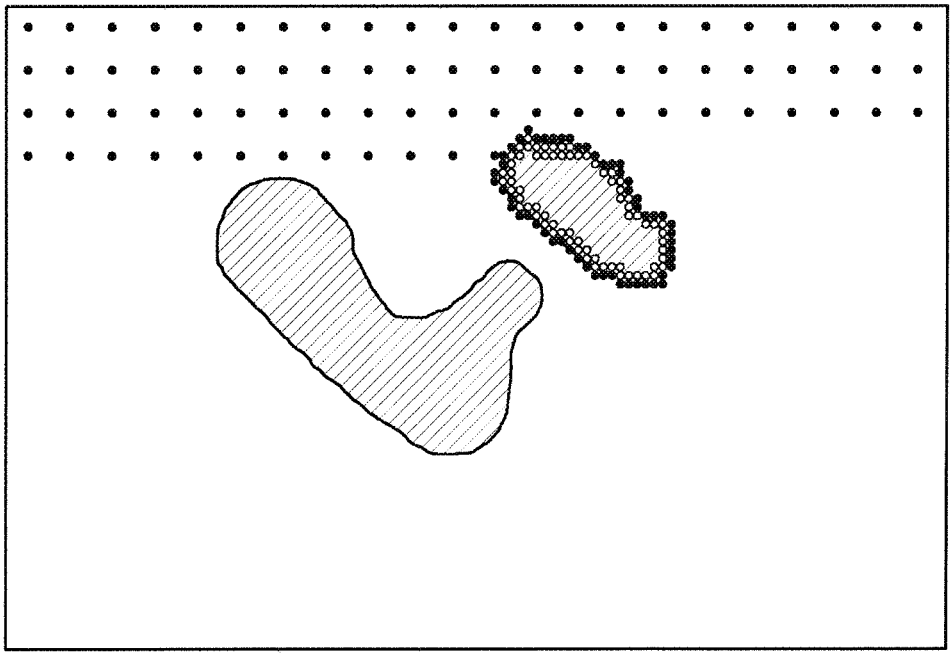
FIG. 7 shows the boundaries of a located region of interest being defined.

FIG. 7 shows the boundaries of a first located region of interest being defined.

Figure 8:
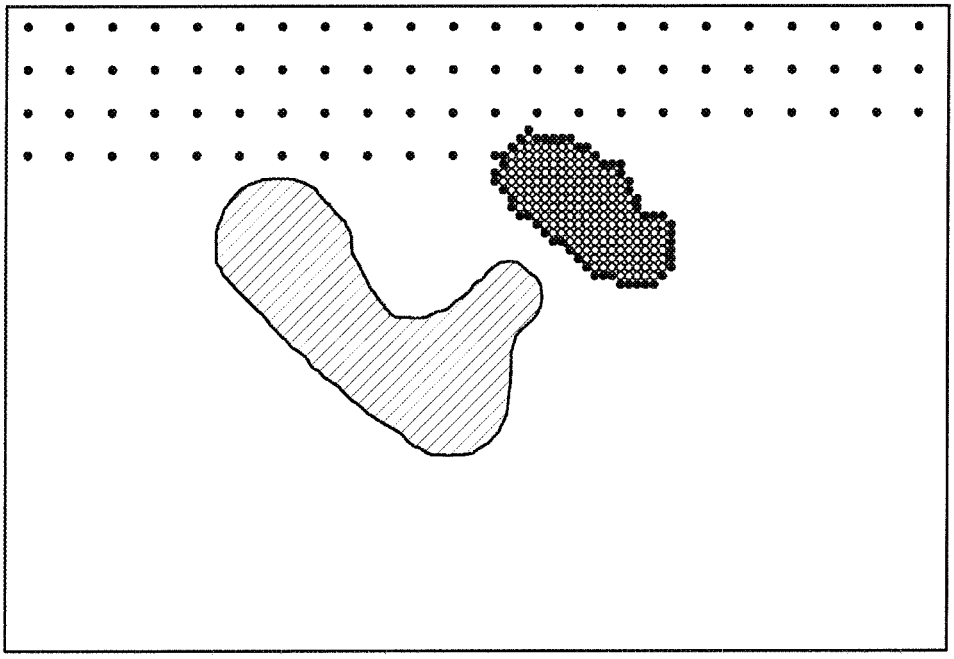
FIG. 8 shows the area within a boundary being interrogated.

FIG. 8 shows the area within the boundary being interrogated.

Figure 9:
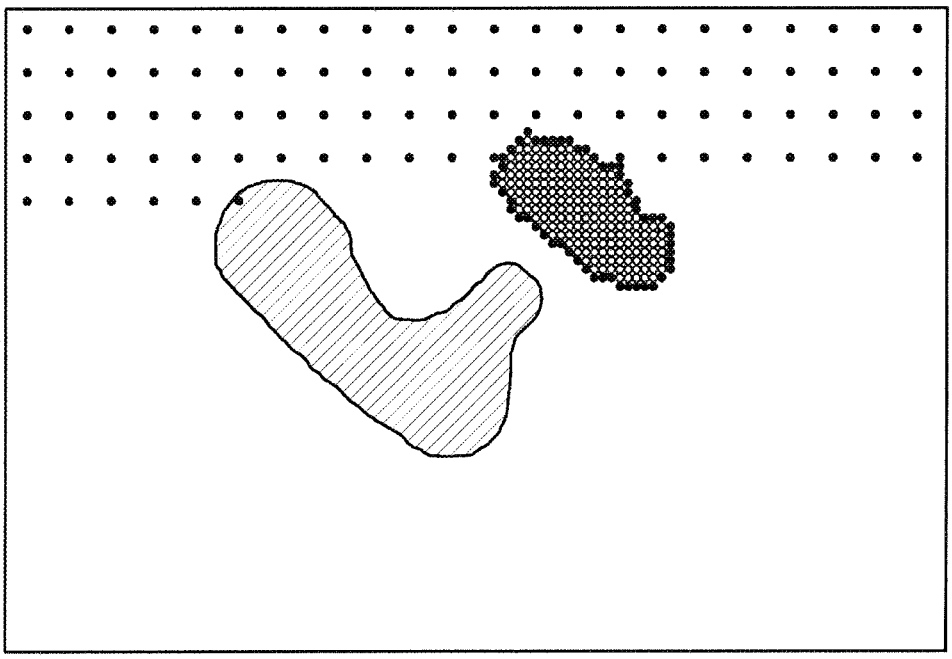
FIG. 9 shows the instrument returning to a coarse scanning mode discarding further MS data until another region of interest is identified.

FIG. 9 shows the instrument returning to perform a coarse scanning and discarding the MS data until a second region of interest is identified.

Figure 10:
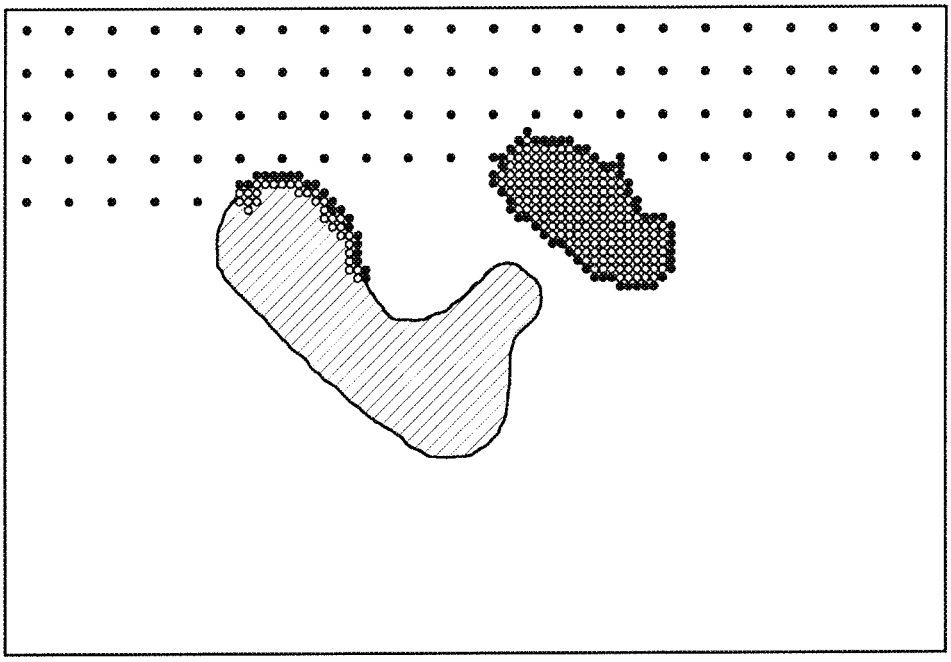
FIG. 10 shows the instrument returning to a high resolution mode for a second time after having identified a second region of interest and starting to determine the extent of the second region of interest.

FIG. 10 shows the instrument returning to a high resolution mode and determining the extent of a second region of interest.

Figure 11:
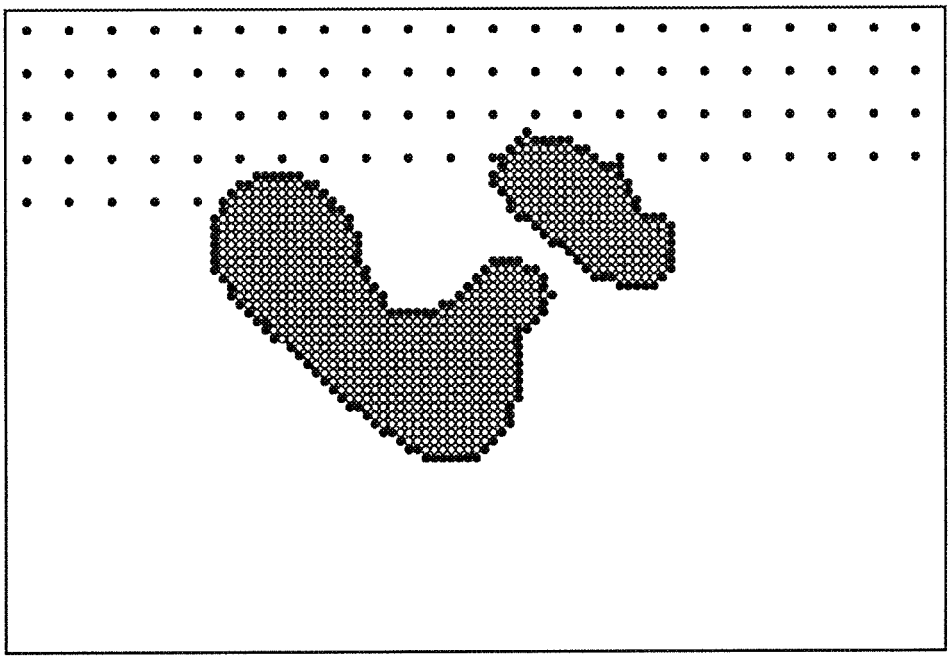
FIG. 11 shows the instrument completing the analysis of the second region of interest.

FIG. 11 shows the instrument completing the analysis of the second region of interest.

Figure 12:
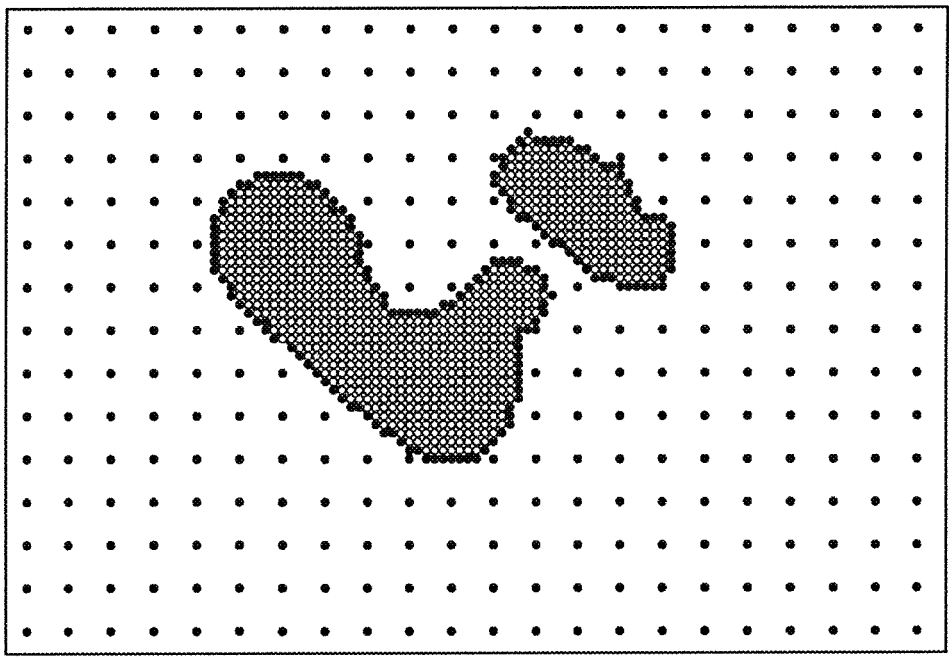
FIG. 12 shows the instrument returning to coarse scanning until the complete sample has been analysed.

FIG. 12 shows the instrument returning to coarse scanning until the complete sample has been analysed.

Figure 13:
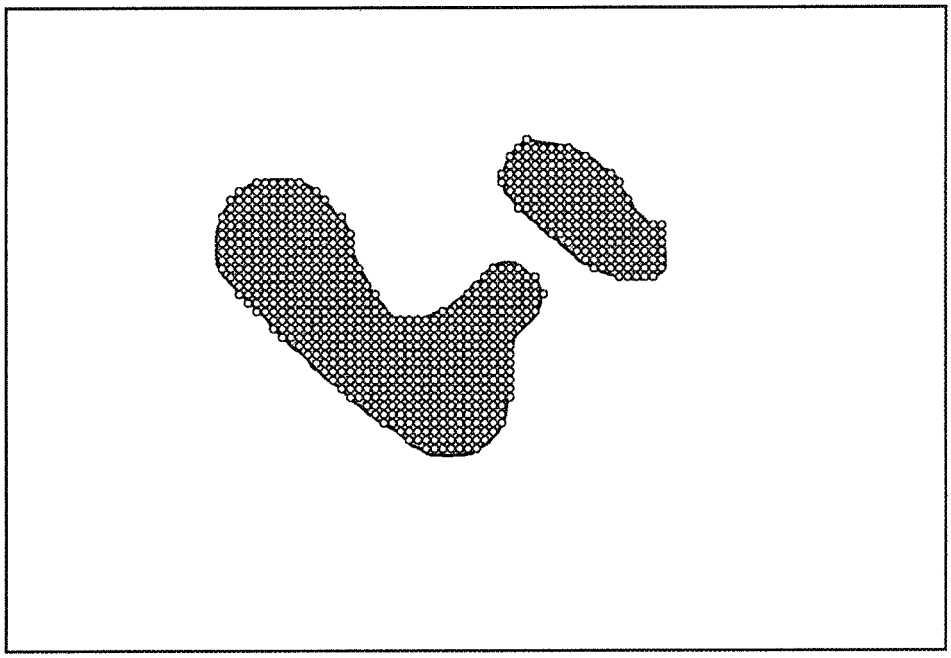
FIG. 13 shows the stored data set which contains mass spectral data relating just to the two regions of interest.

FIG. 13 shows the stored data set which only contains mass spectral data relating to the regions of interest.

Figure 14:
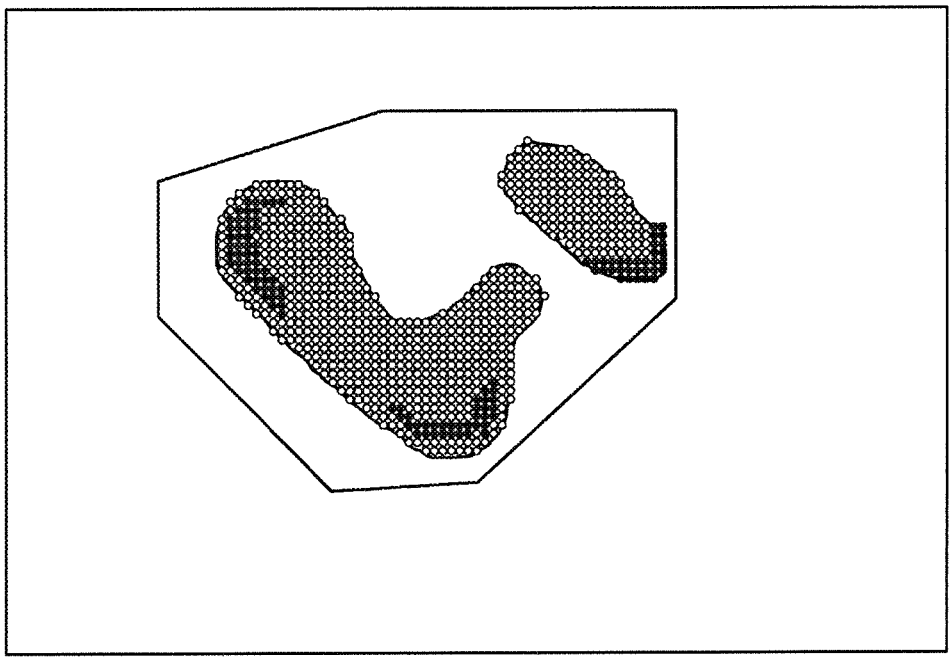
FIG. 14 shows the stored data set being interrogated to determine the localization of specific ions of particular interest within the two regions of interest.

FIG. 14 shows the stored data set being interrogated to determine the localization of specific ions of interest.

Various alternative embodiments are contemplated.

The data sets may comprise MS imaging data, MS/MS imaging data or ion mobility separated MS or MS/MS imaging data.

The condition for storing the spectra may comprise a simple threshold intensity of ions having a particular mass to charge ratio, or a number of predefined mass to charge ratio intensity thresholds. The preferred method may also employ Principle Component Analysis ("PCA") to determine whether the spectrum is of relevance or a database search should be performed (e.g. MASCOT to determine a MOWSE score).

The area interrogated by the coarse search pattern may be predefined by the user or may comprise the whole area of the sample plate.

The high resolution analysis may follow one of several pattern methods including flood fill or scanline fill type movements of the stage. Other local search or tree search approaches may also be employed. Similarly, the coarse search may follow a similar pattern approach at a lower resolution.

The output according to the preferred embodiment may comprise place holders defining the coordinates of the ion image and removal of the spectral content from non-relevant pixel locations whilst retaining MS data and pixel coordinates of pixels determined to be significant, or reducing the data to only the pixel coordinates and associated spectra (or IMS MS) that are determined to be significant.

The technique can be applied to identify specific tissues or regions of interest for interrogation e.g. identification of the locality of a particular organ in an ion image of a tissue section and then to determine the localisation of drugs or metabolites within the particular organ.

According to an embodiment negative result spectra or first mass spectral data which does not satisfy the condition may be discarded. Alternatively, negative result spectra or first mass spectral data which does not satisfy the condition may be stored for future post acquisition analysis and/or confirmation.

Embodiments are contemplated wherein a decision may be made whether or not to discard negative result spectra or to store negative result spectra for post-acquisition analysis.

Although the present invention has been described with reference to preferred embodiments, it will be understood by those skilled in the art that various changes in form and detail may be made without departing from the scope of the invention as set forth in the accompanying claims.

The invention claimed is:

1. A method of ion imaging comprising:

scanning a sample at a first spatial resolution and acquiring first mass spectral data related to a first pixel location;

determining whether or not said first mass spectral data satisfies a condition, wherein if it is determined that said first mass spectral data does satisfy said condition then said method further comprises:

switching to an interrogation of the immediately surrounding pixels at a second spatial resolution which is higher than said first spatial resolution, wherein after each acquisition if the mass spectral data does satisfy said condition then the next pixel is analysed at said second spatial resolution, and if the mass spectral data does not satisfy said condition then the method further comprises returning to a previous pixel before moving to an alternative neighboring location at said second spatial resolution, wherein the extent of a region containing target ions of interest is determined; and then switching back to scanning said sample at said first resolution;

wherein the step of determining whether or not said mass spectral data satisfies said condition comprises determining whether or not said mass spectral data includes ions having one or more mass to charge ratios of interest and an intensity above a threshold, or ions having one or more ion mobilities of interest and an intensity above a threshold.

2. A method as claimed in claim 1, wherein the step of acquiring mass spectral data at said first resolution comprises performing a raster scan of said sample.

3. A method as claimed in claim 1, wherein the step of acquiring mass spectral data at said first resolution comprises performing a random scan, a flood fill, a local search, a scanline or a tree search of said sample.

4. A method as claimed in claim 1, wherein the step of acquiring mass spectral data at said second resolution comprises performing an acquisition pattern.

5. A method as claimed in claim 4, wherein the step of performing said acquisition pattern comprises performing a random scan, a flood fill, a local search, a scanline or a tree search of said sample.

6. A method as claimed in claim 4, wherein the step of performing said acquisition pattern comprises mapping out and acquiring mass spectral data from one or more regions of interest.

7. A method as claimed in claim 6, further comprising determining the location of particular ions of interest within said one or more regions of interest.

8. A method as claimed in claim 7, wherein determining the location of particular ions of interest comprises determining the location of a drug, metabolite, chemical substance or biological substance within the sample.

9. A method of mass spectrometry comprising a method of ion imaging as claimed in claim 1.

10. A mass spectrometer comprising:

a control system arranged and adapted:

(i) to scan a sample at a first resolution and to acquire first mass spectral data related to a first pixel location;

(ii) to determine whether or not said first mass spectral data satisfies a condition, wherein if it is determined that said first mass spectral data does satisfy said condition then said control system is further arranged and adapted:

(iii) to switch to an interrogation of the immediately surrounding pixels at a second spatial resolution which is higher than said first spatial resolution, wherein after each acquisition if the mass spectral data does satisfy said condition then the next pixel is analysed at said second spatial resolution, and if the mass spectral data does not satisfy said condition then the method further comprises returning to a previous pixel before moving to an alternative neighboring location at said second spatial resolution, wherein the extent of a region containing target ions of interest is determined; and then (iv) to switch back to scanning said sample at said first spatial resolution;

wherein the step of determining whether or not said mass spectral data satisfies said condition comprises determining whether or not said mass spectral data includes ions having one or more mass to charge ratios of interest and an intensity above a threshold, or ions having one or more ion mobilities of interest and an intensity above a threshold.

* * * * *